United States Patent [19]

Fritzel

[11] Patent Number: 4,883,347

[45] Date of Patent: Nov. 28, 1989

[54] STABILIZED POINTING MIRROR

[75] Inventor: Bradley G. Fritzel, Hermosa Beach, Calif.

[73] Assignee: Hughes Aircraft Company, Los Angeles, Calif.

[21] Appl. No.: 146,993

[22] Filed: Jan. 22, 1988

[51] Int. Cl.[4] ..... G02B 23/00; G01C 15/14

[52] U.S. Cl. ..... 350/500; 350/636; 356/248

[58] Field of Search ..... 350/500, 636, 637; 356/247, 248, 250, 253; 33/230

[56] References Cited

U.S. PATENT DOCUMENTS

| | | | |
|---|---|---|---|
| 2,811,042 | 10/1957 | Kenyon | 350/500 |
| 3,518,016 | 6/1970 | Burdin et al. | 356/248 |
| 3,552,216 | 1/1971 | Pasquet | 350/500 |
| 3,756,687 | 9/1973 | Shin et al. | 350/500 |
| 4,015,905 | 4/1977 | Lloyd | 350/500 |
| 4,367,913 | 1/1983 | Logan et al. | 350/500 |
| 4,387,971 | 6/1983 | Grove et al. | 350/500 |
| 4,393,597 | 7/1983 | Picard et al. | 356/248 |
| 4,643,539 | 2/1987 | Brignall | 350/500 |

FOREIGN PATENT DOCUMENTS

| | | | |
|---|---|---|---|
| T547310 | 1/1970 | Fed. Rep. of Germany | 350/500 |
| 1422904 | 11/1965 | France | 350/500 |
| 1563217 | 3/1969 | France | 350/500 |

*Primary Examiner*—Bruce Y. Arnold
*Assistant Examiner*—Martin Lerner
*Attorney, Agent, or Firm*—William J. Streeter; Mark J. Meltzer

[57] ABSTRACT

A system is coupled to a pointing mirror (12) for stabilizing it and its line-of-sight (13) from three-dimensional rotational disturbances ($\omega_i$, $\omega_j$, $\omega_k$) exerted thereon. First and second two-degree-of-freedom dynamically tuned gyroscopes (26, 28) are secured to the mirror and placed respectively on its elevation and azimuth axes (22, 24). The first gyroscope (26) is coupled to electronic apparatus (30) to provide inertial rates ($\omega_4^*$, $\omega_2^*$) of the mirror respectively about an axis (13) angled from a line (17) normal thereto and about the elevation axis. The second gyroscope (28) is coupled to the electronic apparatus to provide inertial rates ($\omega_2$, $\omega_3$) of the mirror respectively about its pitch and yaw axes. Inertial rates ($\omega_e$, $\omega_d$) of angular motion of the mirror respectively about its line-of-sight pitch and yaw axes (e, d) are calculated from the inertial rate ($\omega_4^*$, $\omega_2^*$, $\omega_2$, $\omega_3$), and summed to zero so that torques (23, 25) stabilize the mirror and its line-of-sight about its elevation and azimuth axes.

7 Claims, 4 Drawing Sheets

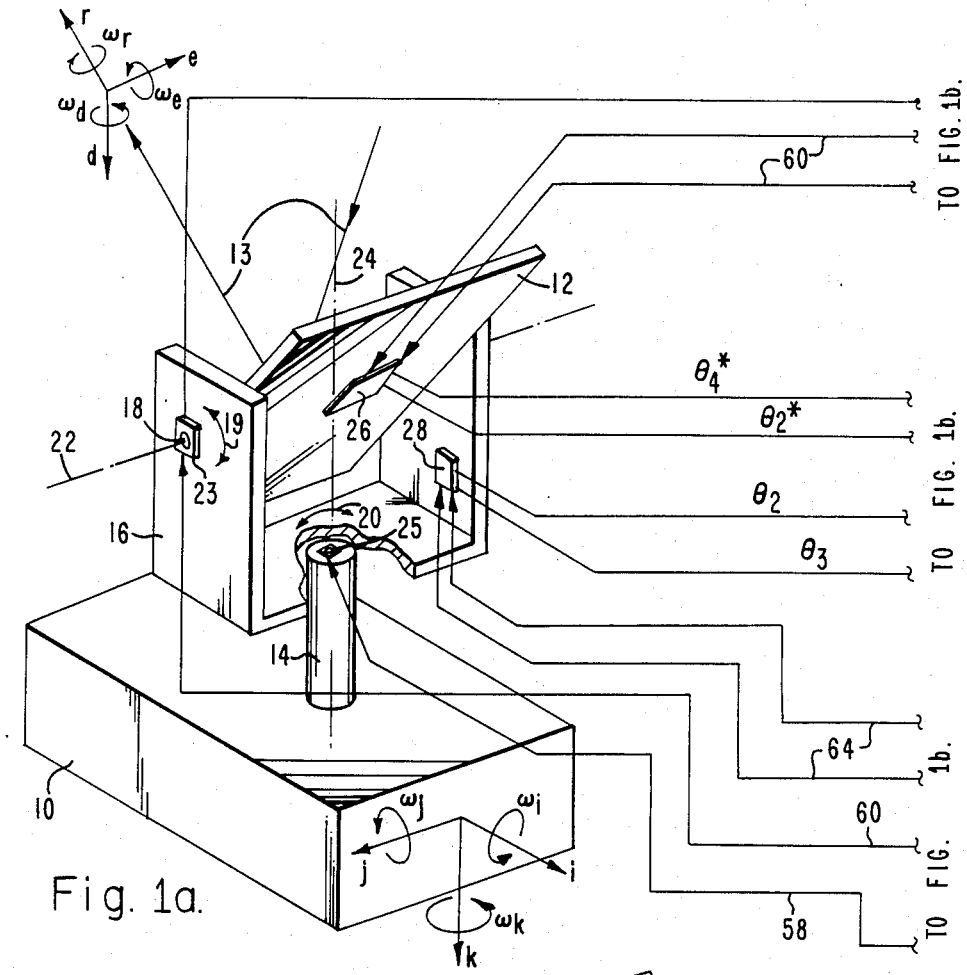
Fig. 1a.
Fig. 2.
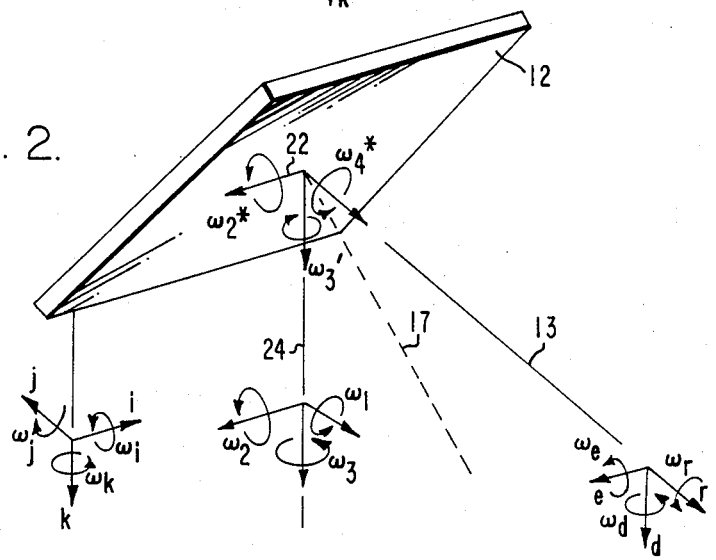

STABILIZED POINTING MIRROR

BACKGROUND OF THE INVENTION

The present invention relates to the stabilization of a gimbaled pointing mirror and, in particular, to a simplified and accurate system therefor.

It is important to stabilize a pointing mirror against angular base motions with respect to an inertial reference, such as a field of view, especially when the pointing mirror is mounted on a moving vehicle. Movements imparted to the vehicle are transmitted to the mirror through rotations about any or all of the x, y, and z or i, j, and k axes.

Prior stabilized pointing mirror designs utilized two rate-integrating, single-degree-of-freedom gyroscopes, which were attached to a separately gimbaled reference inertia. While operating adequately to stabilize the mirror, these prior designs required a relatively large number of mechanical parts, which both increased the complexity and cost of the pointing mirror system. In addition, as the number of electrical and mechanical parts increased, the possibility of error also increased, thereby decreasing its pointing accuracy.

Such prior systems are exemplified in "The Infrared Handbook" by Wolfe and Zissis, editors, prepared by the Infrared Information and Analysis (IRIA) Center, Environmental Research Institute of Michigan for the Office of Naval Research, Department of the Navy, Washington, D.C., First Edition 1978, Revised Edition 1985, in Chapter 22 entitled "Tracking Systems" pages 22-1 et seq., specifically, pages 22-9 and 22-10. There, the pointing mirror is secured mechanically by belts or bands to a balanced inertia band drive and a gyroscopically stabilized reference. When either or both of the balanced inertia band drive and gyroscopically stabilized reference are balanced, the mirror is balanced. However, that structure is mechanically and electronically complex, entails additional structure which prevents attainment of high bandwidth control or closure of the electro-mechanical loop from the mirror to the electronics and back to the mirror. As is known, the higher the bandwidth, the higher the frequencies that can be attenuated. However, as stated above, as the mechanical parts become more complex, it becomes more difficult to get stable loop closure. The problem is primarily in the mechanics which do not have sufficient structural integrity, that is, the ability to respond to input demands, which detracts from stable loop closure and results in oscillation of the mirror.

SUMMARY OF THE INVENTION

The present invention avoids these and other problems by utilizing two two-degree-of-freedom dynamically tuned gyroscopes. The gyroscopes are secured to the mirror and its supporting structure in such a manner that it can sense selected angular rotations of the mirror caused by disturbances placed on a vehicle to which the mirror is attached.

In the preferred embodiment, a specific set of rotational angular rates are selected over all other rates. The selected angular rates include four vectors, viz., the vector that measures the mirror elevation, the vector that is oriented at an angle to the mirror normal, the vector that measures the elevation of the azimuth gimbal, and the vector which measures the azimuth gimbal. It has been found that the preferred angle of the vector, which is oriented at an angle to the mirror normal, is 45°. These four vectors are then used to compute the inertial vector rates of angular motion of the mirror respectively about its line-of-sight pitch and yaw axes. These latter two vectors are summed to equal zero, which is the point where the line-of-sight is stable. The selection of the above-mentioned four vectors simplify the calculations for summing the later two vectors to zero. By simplifying the equations, both the electronic and mechanical systems can, in turn, be simplified, which thereby increases accuracy.

Several aims and advantages accrue therefrom. Primarily the inventive stabilized pointing mirror design is simple, relative to prior art designs. The projected costs to produce it are considerably reduced over known costs of other existing stabilized pointing mirrors. By eliminating the prior art use of two rate integrating single-degree-of-freedom gyroscopes, which are attached to separately gimbaled reference inertia, in favor of the inventive pair of two-degree-of-freedom dynamically tuned gyroscopes, a considerable reduction in the number of mechanical parts is obtained. In addition to the reduction in cost, the reduced number of mechanical parts increases accuracy.

Other aims and advantages, as well as a more complete understanding of the present invention, will appear from the following explanation of an exemplary embodiment and the accompanying drawings thereof.

DESCRIPTION OF THE DRAWINGS

FIGS. 1*a* and 1*b* schematically depict the preferred embodiment of the present invention, showing a pointing mirror supported on a vehicle illustrated as a base, and a block diagram of the system stabilizing the mirror and, thus, for stabilizing its line-of-sight from three-dimensional rotationally disturbances exerted upon the mirror;

FIG. 2 is a diagramatic view of the mirror of FIG. 1, showing the angular rotational vectors along the elevation and azimuth axes and the line-of-sight;

DESCRIPTION OF THE PREFERRED EMBODIMENT

Figure 1B:
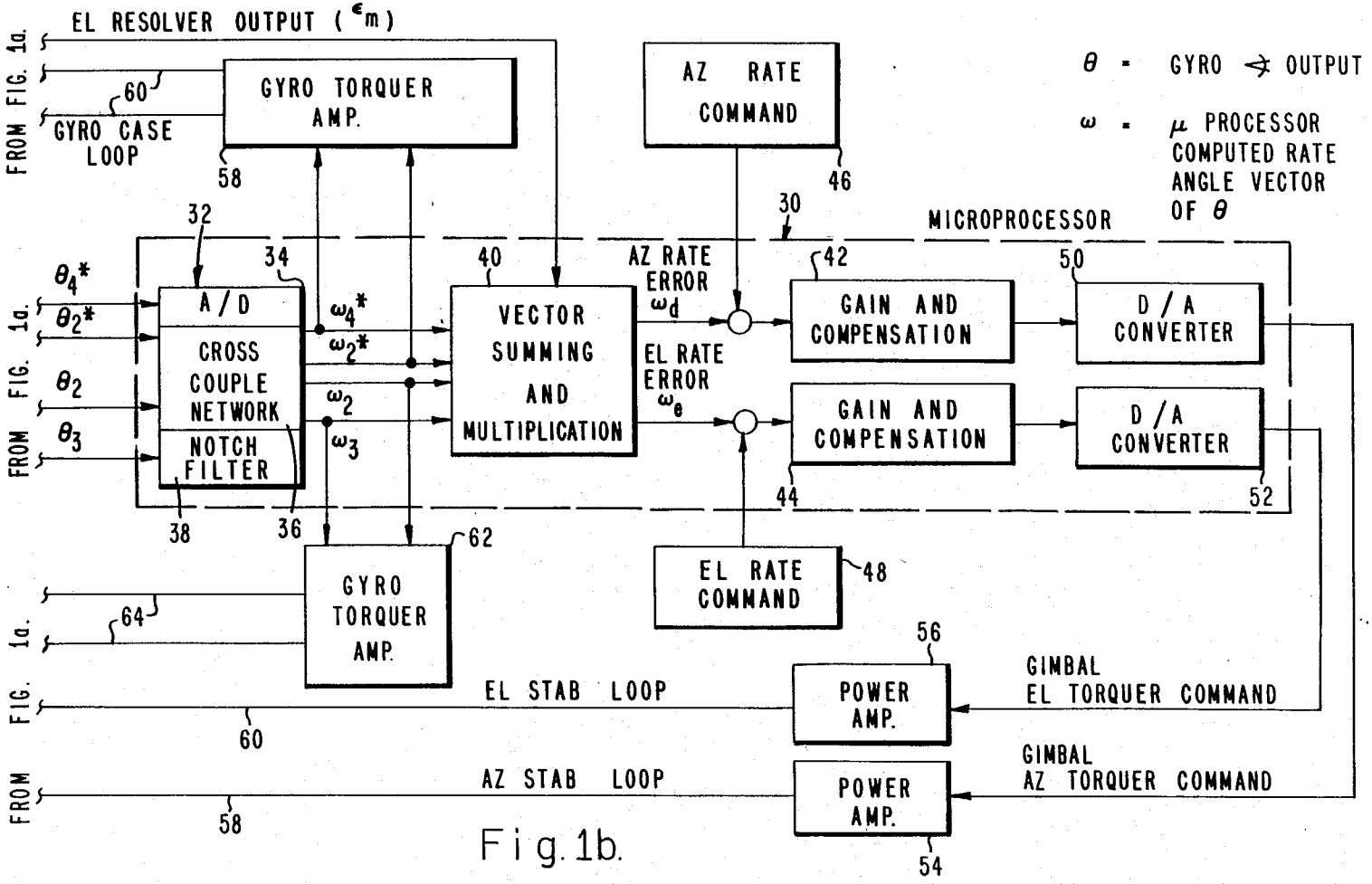

Referring to FIG. 1*a*, a vehicle 10, such as a tank, is represented by a rectangular parallelepiped. As the vehicle moves, it is subject to three-dimensional disturbances, shown as occurring along three orthogonally disposed axes i, j, and k, and designated by angular rate vectors $\omega_i$, $\omega_j$ and $\omega_k$.

A pointing mirror 12, having a line-of-sight 13 (see also FIG. 2), is mounted on vehicle 10 by a post 14 to which a bracket 16 is secured. Line-of-sight 13 is angled from a line 17 which is normal to the mirror. Mirror 12 is mounted on bracket 16 on a shaft 18. The mirror is angularly movable with respect to bracket 16 about shaft 18, and bracket 16 is angularly movable with respect to post 14 as respectively denoted by double-headed arrow lines 19 and 20. Because shaft 18 is orthogonally disposed with respect to post 14, mirror 12 has two orthogonal degrees of rotation with respect to vehicle 10. These two degrees of angular rotation are centered about an axis 22 of elevation, which passes through shaft 18, and about an azimuth axis 24, which passes through post 14. Azimuth and elevation resolver-torquers 23 and 25 are coupled respectively to shaft 18 and post 14.

As best shown in FIG. 2, angular disturbances exerted upon vehicle 10, as denoted by angle rate vectors $\omega_i$, $\omega_j$ and $\omega_k$, are translated through post 14 and bracket 16 to mirror 12 and cause jitter of line-of-sight 13. This jitter may be represented as angular motions about the orthogonal axes r, e, and d, respectively, the roll, pitch and yaw axes. The angular motions about these axes are represented by angular rate vectors $\omega_r$, $\omega_e$, and $\omega_d$. The values of these vectors can be obtained most easily by an analysis of the perturbations about elevation axis 22 and azimuth axis 24. Specifically, the angular disturbances about each of these axes may be represented by angular rate vectors $\omega_2^*$, $\omega_3'$ and $\omega_4^*$ for elevation axis 22 and angular rate vectors $\omega_1$, $\omega_2$ and $\omega_3$ for azimuth axes 24. Thus, the input disturbances on vehicle 10 through its angular rate vectors $\omega_i$, $\omega_j$ and $\omega_k$ may be correlated to selected ones of angular rate vectors selected from $\omega_2^*$, $\omega_3'$, $\omega_4^*$, $\omega_1$, $\omega_2$ and $\omega_3$. As will be discussed later, it is necessary to utilize only four of these latter six vectors in order to simplify the necessary calculations for obtaining the values of $\omega_d$ and $\omega_e$ and for bringing their values to zero.

To obtain the several angular rate vector values from mirror 12, a pair of two-degree-of-freedom gyroscopes 26 and 28 are fixed respectively to mirror 12 and bracket 16. Preferably, these gyroscopes comprise dynamically tuned gyroscopes of conventional construction They are also sometimes called "dry tuned" gyroscopes. Gyroscope 26 is so affixed to mirror 12 as to detect the angular disturbances about elevation axis 22, as it moves about its elevation gimbal. Thus, gyroscope 26 may be referred to as an elevation gimbal gyroscope. Gyroscope 28 is affixed to bracket 16 in such a manner that it will sense angular disturbances about azimuth axis 24 and, therefore, it is sometimes referred to as the azimuth gimbal gyroscope. For the purposes of the present invention, it is only necessary to detect four angular disturbances denoted $\theta_2$ and $\theta_3$ which are sensed by azimuth gimbal gyroscope 28 and those denoted $\theta_2^*$ and $\theta_4^*$ which are sensed by elevation gimbal gyroscope 26.

As shown in FIG. 1*b*, these four angular disturbances are appropriately converted in a microprocessor 30 by internal electronic devices 32, comprising an analog to digital (A/D) converter 34, a cross couple network 36 and a notch filter 38 which process the angular disturbance inputs to provide angular rate vectors $\omega_4^*$, $\omega_2^*$, $\omega_2$ and $\omega_3$. Both microprocessor 30 and electronic devices 32, as well as all other components of the microprocessor are conventional. The preferred microprocessor comprises a single-chip microprocessor which is optimized for digital signal processing and other high-speed numeric processing applications. It integrates computational units, data addressed generators and a program sequencer in a single device. Such a microprocessor 30 may be obtained from Analog Devices of Norwood, Mass., comprising its DSP Microprocessor, Model ADSP-2100, which is described in Analog Devices' product brochure C1064-21-4/87. While a preferred and particular microprocessor is herein described, it is to be understood that any equivalent microprocessor or electronic devices are similarly useful.

The output from electronic devices 32, in terms of their angular rate vectors, is furnished to a vector summing and multiplication device 40 and combined therein with the elevation angle $\epsilon_m$ of mirror 12, which is obtained from elevation resolver 25. Device 40 produces a pair of outputs comprising an azimuth rate error $\omega_d$ and an elevation rate error $\omega_e$ which are fed into respective gain and compensation electronic devices 42 and 44. These error signals may be modified respectively by an azimuth rate command device 46 and an elevation rate command device 48. Devices 46 and 48 are of conventional design and are generally operated by a joystick.

The signals furnished to the gain and compensation devices are then converted into analog signals by digital to analog (D/A) converters 50 and 52. These analog signals are then fed to power amplifiers 54 and 56 of conventional design in terms of respective gimbal azimuth torquer commands and gimbal elevation torquer commands. The amplified signals then proceed along an azimuth stabilization loop 58 and an elevation stabilization loop 60, which are furnished respectively to azimuth torquer and resolver 25 and to elevation torquer and resolver 23.

Feedback of rate vectors $\omega_4^*$ and $\omega_2^*$ are also taken from the output of electronic devices 32 and fed to a gyroscope torquer amplifier 58 which provides signals through gyroscope case loop 60 back to gyroscope 26. In a like manner, signals of vector outputs $\omega_2$ and $\omega_3$ are fed to a gyroscope torquer amplifier 62 whose signals are transmitted through gyroscope case loop 64 to gyroscope 28.

Figure 3A:
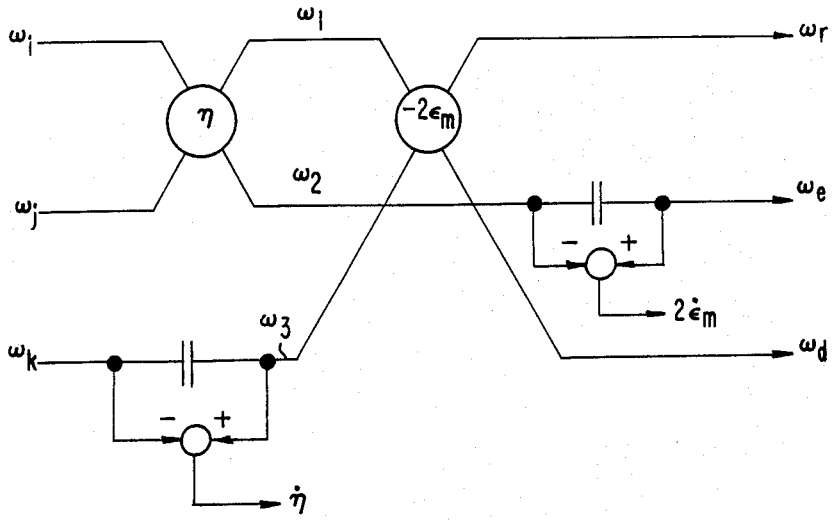
FIGS. 3*a* and 3*b* are graphic (symbolic) representations of mathematical computations in processing of vector quantities derived from angular rate signals.
Figure 3B:
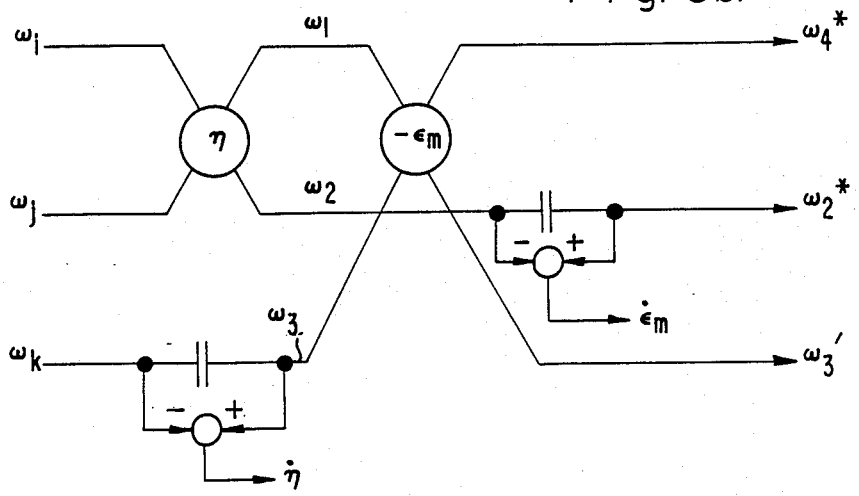
Figure 4:
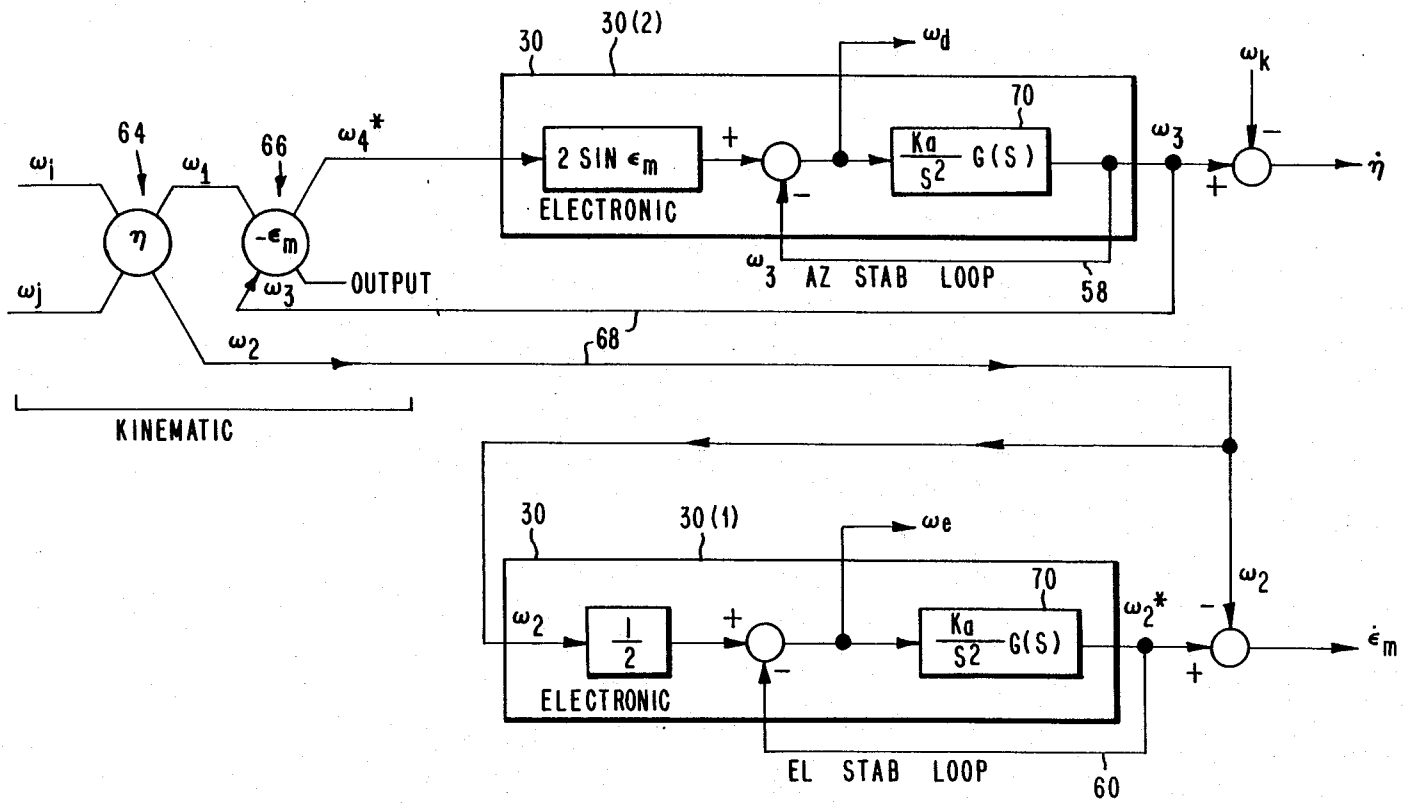
FIG. 4 is a graphic (symbolic) representation of the mathematical computation used in stabilizing the mirror and its line-of-sight.

The processing of the various vector quantities may be understood with reference to FIGS. 3*a* and 3*b*. FIGS. 3*a* and 3*b* are graphic representations of the processing of the vector quantities, and is explained in part, by use of piograms, see "Algebra of Piograms or Orthogonal Transformations Made Easy" by Richard L. Pio, Hughes Aircraft Company Report No. M78-170, copyright 1978, 1981, and 1985. See also, "Euler Angle Transformations" by Richard L. Pio, IEEE Transactions on Automatic Control, Volume AC-11, No. 4, pages 707–715, October 1966. Specifically, a piogram is a symbolic representation of coordinate transformations. In FIG. 4, the angular disturbances denoted by vectors $\omega_i$ and $\omega_j$ are transformed into vector quantities $\omega_1$ and $\omega_2$ through an $\eta$ transformation process caused by the azimuth angle of mirror 12 mounted at piogram 64. A similar transformation through the elevation angle $-\epsilon_m$ of mirror 12 occurs as shown by piogram 66. Both these transformations occur kinematically. Lines 68 also represent kinematic paths. The output signals are fed into microprocessor 30 which, for purposes of clarity in the drawing, has been divided into two blocks 30(1) and 30(2) in FIG. 4. The electronic processing of the several vector quantities are calculated according to the equations:

$$\omega_e = 2\omega_2^* - \omega_2, \text{ and} \quad (1)$$

$$\omega_d = \omega_3 + (2 \sin \epsilon_m)(\omega_4^*) \quad (2)$$

Equation (1) is shown as being processed within that portion of microprocessor 30 designated as portion 30(1), while equation (2) is processed within that portion 30(2). The mathematical expression within each of enclosures 70 represent the gain and compensation within the respective loops. Indicia 58 and 60 respectively indicate the azimuth stabilization loop and the elevation stabilization loop, also shown in FIGS. 1*a* and 1*b*. When the processing is such that the respective vector quantities $\omega_e$ and $\omega_d$ both become zero, line-of-sight 13 becomes stable.

Transformation 64 illustrates how the roll and pitch rates $\omega_i$ and $\omega_j$ are resolved through an $\eta$ transformation to obtain vector quantities $\omega_1$, which is the inertial rate of the azimuth gimbal about the roll axis, and $\omega_2$, which is the inertial rate of the azimuth gimbal about the pitch axis. In a similar manner, the rate vectors $\omega_1$ and $\omega_3$ are resolved through a $-\epsilon_m$ transformation to obtain $\omega_4^*$ which is the inertial rate of angular motion of mirror 12 about an axis angled at 45° to its normal and another output which is not used in the present invention.

More specifically, FIGS. 1 and 2 define the necessary coordinate systems to explain the operation of the present invention. It is to be noted that sensor line-of-sight 13 is always fixed, while steering mirror 12 about either azimuth or elevation axes 24, 22 will aim line-of-sight 13 of the mirror.

The coordinate system definition of the terms shown in FIGS. 1 and 2 is:

$\omega_i$, $\omega_j$, $\omega_k$=Inertial base rates about the roll, pitch, and yaw axes (i, j and k), respectively, $\omega_1$, $\omega_2$, $\omega_3$=Inertial rates of the azimuth gimbal about the roll, pitch, and yaw axes, respectively, $\omega_4^*$, $\omega_2^*$, $\omega_3'$=Inertial rates of the mirror about an axis (13) which is 45° from the mirror normal (17), the mirror elevation axis (22), and an axis (24) orthogonal to the first two axes, $\omega_4^*$, $\omega_2^*$, $\omega_3^*$=Inertial rates of the mirror about the mirror normal (17), the mirror elevation axis (22) and an axis orthogonal to the first two, $\omega_r$, $\omega_e$, $\omega_d$=Inertial rates of the roll, pitch, and yaw axes of the line-of-sight, respectively, and $\eta$, $\epsilon_m$=Rotation angles about the azimuth and elevation axes, respectively.

The geometrical relationship between the inertial rates defined above is illustrated with the aid of the piogram shown in FIGS. 3*a* and 3*b*.

In order to stabilize line-of-sight 13, inertial rates $\omega_e$ and $\omega_d$ must be zero for any base motion input rates, $\omega_i$, $\omega_j$ or $\omega_k$.

The derivation and implementation of the elevation stabilization will be discussed first, followed by that for azimuth.

From FIGS. 3*a* and 3*b*, the following two equations can be written as:

$$2\dot{\epsilon}_m=\omega_e-\omega_2 \quad (3)$$

$$\dot{\epsilon}_m=\omega_2^*-\omega_2 \quad (4)$$

For elevation stabilization $\omega_e\equiv 0$, then equation (3) is:

$$0=2\dot{\epsilon}_m+\omega_2 \quad (5)$$

Rewriting equation (4) as $$\omega_2^*=\dot{\epsilon}_m+\omega_2 \text{ and} \quad (4)$$

multiplying equation (4) by two and subtracting from equation (5)

$$0 = 2\dot{\epsilon}_m + \omega_2 \quad (5)$$

$$\frac{-2\omega_2^* = -2\dot{\epsilon}_m - 2\omega_2}{-2\omega_2^* = -\omega_2} \quad (4)$$

or $$2\omega_2^*-\omega_2=0 \quad (6)$$

Equation (6) requires a measurement of the mirror elevation inertial rate ($\omega_2^*$) and the elevation inertial rate of the azimuth gimbal ($\omega_2$). These measurements are provided by one axis each of two dynamically-tuned-gyroscopes. As stated above, one gyroscope is mounted on the elevation gimbal or axis of the mirror, and the other gyroscope is mounted on the azimuth gimbal. The orientation of the remaining two axes of each dynamically-tuned-gyroscope will be established by the requirements to provide azimuth stabilization.

A simple servo block diagram for elevation stabilization is also shown in FIG. 4.

In this implementation $\omega_2^*$ is servo driven always to be equal to $\frac{1}{2}$ times $\omega_2$ which satisfies the relationship to make $\omega_e=0$.

Regarding azimuth stabilization, since no reference gimbal exists in this design, the azimuth stabilization rate can no longer be directly measured with an inertial gyroscope; however, a simple implementation is to measure the inertial azimuth gimbal rate about the azimuth and to measure the inertial rate $\omega_4^*$, a rate fixed to the mirror but rotated 45° from the mirror normal.

From FIGS. 3*a* and 3*b* the following equations can be written:

$$\omega_d=\omega_e \cos 2\epsilon_m+\omega_1 \sin 2\epsilon_m \quad (7)$$

$$\omega_4^*=\omega_1 \cos \epsilon_m-\omega_3 \sin \epsilon_m \quad (8)$$

Solving for $\omega_1$ from equation (8), $$\omega_1 = \frac{\omega_4^*}{\cos \epsilon_m} + \omega_3 \tan \epsilon_m \quad (9)$$

Substituting equation (9) into equation (7), $$\omega_d = \omega_3 \cos 2\epsilon_m + \sin 2\epsilon_m \left( \frac{\omega_4^*}{\cos \epsilon_m} + \omega_3 \tan \epsilon_m \right)$$

$$\omega_d = \omega_3 (\cos 2\epsilon_m + \sin 2\epsilon_m \tan \epsilon_m) + \omega_4^* \left( \frac{\sin 2\epsilon_m}{\cos \epsilon_m} \right)$$

It can be shown that $$\cos 2\epsilon_m+\sin 2\epsilon_m \tan \epsilon_m\equiv 1$$

and $$\left( \frac{\sin 2\epsilon_m}{\cos \epsilon_m} \right) = 2 \sin \epsilon_m$$

Therefore, $\omega_d=\omega_3+2\omega_4^* \sin \epsilon_m$

Angular rate vector $\omega_3$ is servo driven always to be equal to $-2\omega_4^* \sin \epsilon_m$ which satisfies equation (10) and makes $\omega_d=0$. Angular rate vector $\omega_3$ is derived from the other available axis of gyroscope 28 mounted on the azimuth gimbal. Angular rate vector $\omega_4^*$ is derived from the other available axis of elevation gyroscope 26 mounted on the mirror.

Thus, the implementation of the stabilized mirror is accomplished two two dynamically-tuned-gyroscopes, one mounted on the mirror and one mounted on the azimuth gimbal. The azimuth gimbal yoke and the mirror can be made lightweight to minimize the size of the torquers and bearings to drive the gimbaled mirror. This has direct impact on the cost to produce the design.

Although the invention has been described with respect to a particular embodiment thereof, it should be realized that various changes and modifications may be made therein without departing from the spirit and scope of the invention.

I claim:

1. A pointing mirror, having a line-of-sight and supported on gimbals about an elevation axis and an azimuth axis, and a system coupled to the mirror for stabilizing the mirror and, thus, for stabilizing its line-of-sight from three-dimensional rotational disturbances exerted upon the mirror, comprising:

a first two-degree-of-freedom gyroscope secured to the mirror and placed on a first of the axes, said first two-degree-of-freedom gyroscope being coupled to electronic means for providing inertial rates ($\omega_4^*$, $\omega_2^*$) of angular motion of the mirror respectively about an axis angled from a line normal thereto and about the first axis;

a second two-degree-of-freedom gyroscope secured to the gimbal on the second of the axes, said second two-degree-of-freedom gyroscope being coupled to electronic means for providing inertial rates ($\omega_2$, $\omega_3$) of angular motion of the mirror respectively about a pitch axis and a yaw axis;

means for computing inertial rates ($\omega_e$, $\omega_d$) of angular motion of the mirror respectively about a line-of-sight pitch axis and a line-of-sight yaw axis from the inertial rates ($\omega_4^*$, $\omega_2^*$, $\omega_2$, $\omega_3$); and means for summing the inertial rates ($\omega_e$, $\omega_d$) to zero and thus for driving the mirror about its elevation and azimuth axes to stabilize its line-of-sight.

2. A pointing mirror and line-of-sight stabilizing system therefor according to claim 1 in which said first and second gyroscopes comprise dynamically tuned two-degree-of-freedom gyroscopes.

3. A pointing mirror and line-of-sight stabilizing system therefor according to claim 2, wherein the angled axis, about which the inertial rate ($\omega_4^*$) is sensed by the first two-degree-of-freedom gyroscope, is placed 45° from the normal line.

4. A pointing mirror, having a line-of-sight and supported on gimbals about an elevation axis and an azimuth axis, and a system coupled to the mirror for stabilizing the mirror and, thus, for stabilizing its line-of-sight from three-dimensional rotational disturbances exerted upon the mirror, comprising:

a first two-degree-of-freedom gyroscope secured to the mirror and placed on a first of the axes, said first two-degree-of-freedom gyroscope being coupled to electronic means for providing inertial rates ($\omega_4^*$, $\omega_2^*$) of angular motion of the mirror respectively about an axis angled from a line normal thereto and about the first axis, the angled axis, about which the inertial rate ($\omega_4^*$) is sensed by the first two-degree-of-freedom gyroscope, being placed 45° from the normal line;

a second two-degree-of-freedom gyroscope secured to the gimbal on the second of the axes, said second two-degree-of-freedom gyroscope being coupled to electronic means for providing inertial rates ($\omega_2$, $\omega_3$) of angular motion of the mirror respectively about a pitch axis and a yaw axis;

means for computing inertial rates ($\omega_e$, $\omega_d$) of angular motion of the mirror respectively about a line-of-sight pitch axis and a line-of-sight yaw axis from the inertial rates ($\omega_4^*$, $\omega_2^*$, $\omega_2$, $\omega_3$), said computing means mathematically interrelating the inertial rates according to the equations:

$$\omega_e = 2\omega_2^* - \omega_2, \text{ and}$$

$$\omega_d = \omega_3 + (2 \sin \epsilon_m)(\omega_4^*),$$

where $\epsilon_m$ is the rotation angle about the elevation axis of the mirror; and means for summing the inertial rates ($\omega_e$, $\omega_d$) to zero and thus for driving the mirror about its elevation and azimuth axes to stabilize its line-of-sight.

5. A pointing mirror and line-of-sight stabilizing system therefor according to claim 4 further including means for commanding movement of the mirror about its elevation and azimuth axes.

6. A pointing mirror and line-of-sight stabilizing system therefor according to claim 5 in which said driving means comprises torquers secured to structure coupled to the mirror for angularly moving the mirror about its elevation and azimuth axes.

7. A pointing mirror, having a line-of-sight and supported on gimbals about an elevation axis and an azimuth axis, and a system coupled to the mirror for stabilizing the mirror and, thus, for stabilizing its line-of-sight from three-dimensional rotational disturbances exerted upon the mirror, comprising:

a first two-degree-of-freedom gyroscope secured to the mirror and placed on a first of the axes, said first two-degree-of-freedom gyroscope being coupled to electronic means for providing inertial rates ($\omega_4^*$, $\omega_2^*$) of angular motion of the mirror respectively about an axis angled from a line normal thereto and about the first axis;

a second two-degree-of-freedom gyroscope secured to the gimbal on the second of the axes, said second two-degree-of-freedom gyroscope being coupled to electronic means for providing inertial rates ($\omega_2$, $\omega_3$) of angular motion of the mirror respectively about a pitch axis and a yaw axis;

means for computing inertial rates ($\omega_e$, $\omega_d$) of angular motion of the mirror respectively about a line-of-sight pitch axis and a line-of-sight yaw axis from the inertial rates ($\omega_4^*$, $\omega_2^*$, $\omega_2$, $\omega_3$), said computing means mathematically interrelating the inertial rates according to the equations:

$$\omega_e = 2\omega_2^* - \omega_2, \text{ and}$$

$$\omega_d = \omega_3 + (2 \sin \epsilon_m)(\omega_4^*),$$

where $\epsilon_m$ is the rotation angle about the elevation axis of the mirror; and means for summing the inertial rates ($\omega_e$, $\omega_d$) to zero and thus for driving the mirror about its elevation and azimuth axes to stabilize its line-of-sight.

* * * * *

UNITED STATES PATENT AND TRADEMARK OFFICE

CERTIFICATE OF CORRECTION

PATENT NO. : 4,883,347

DATED : November 28, 1989

INVENTOR(S) : BRADLEY G. FRITZEL

It is certified that error appears in the above-identified patent and that said Letters Patent is hereby corrected as shown below:

Column 7, line 47, claim 3 dependence from "claim 2" has been corrected to read "claim 1".

Signed and Sealed this

Third Day of September, 1991

*Attest:*

*Attesting Officer*

HARRY F. MANBECK, JR.

*Commissioner of Patents and Trademarks*